US005359739A

United States Patent [19]

Rains et al.

[11] Patent Number: 5,359,739

[45] Date of Patent: Nov. 1, 1994

[54] PATIENT REPOSITIONING AND POSITION MAINTENANCE DEVICE

[75] Inventors: Thersa J. Rains; Mark Pempsell, both of Wagoner, Okla.

[73] Assignee: DeMar Technologies, Inc., Wagoner, Okla.

[21] Appl. No.: 113,076

[22] Filed: Aug. 30, 1993

[51] Int. Cl.[5] ..... A61G 12/00; A47G 9/00; A47C 21/08

[52] U.S. Cl. ..... 5/81.1; 5/632; 5/424; 5/648; 5/922

[58] Field of Search ..... 5/655, 630, 640, 632, 5/465, 424, 425, 81.1, 648, 650

[56] References Cited

U.S. PATENT DOCUMENTS

| | | | |
|---|---|---|---|
| D. 343,756 | 2/1994 | Sher | 5/655 |
| 2,644,173 | 7/1953 | James | 5/425 |
| 2,952,856 | 9/1960 | Ruff | 5/636 |
| 3,284,816 | 11/1966 | Laubsch | 5/81.1 |
| 3,802,704 | 4/1974 | Genua | 5/491 |
| 3,829,814 | 8/1974 | Treat | 5/81.1 |
| 3,924,282 | 12/1975 | Bond | 5/632 |
| 4,723,327 | 2/1988 | Smith . | |
| 4,726,087 | 2/1988 | Schaffer et al. | 5/901 |
| 4,754,509 | 7/1988 | Pollard | 5/425 |
| 4,872,226 | 10/1989 | Lonardo | 5/81.1 |
| 4,872,228 | 10/1989 | Bishop | 5/425 |
| 4,873,734 | 10/1989 | Pollard | 5/425 |
| 4,899,405 | 2/1990 | Rothbard | 5/901 |
| 4,910,818 | 3/1990 | Grabill et al. | 5/648 |
| 5,148,558 | 9/1992 | Dunn | 5/81.1 |
| 5,165,130 | 11/1992 | Wendling | 5/655 |
| 5,193,238 | 3/1993 | Clute | 5/655 |
| 5,272,780 | 12/1993 | Clute | 5/655 |

*Primary Examiner*—Alexander Grosz

*Attorney, Agent, or Firm*—C. Dale Quisenberry; William S. Dorman

[57] ABSTRACT

A patient repositioning and position maintenance device wherein the apparatus includes a rectangular sheet of fabric material which is folded and fastened such that a rectangular patient resting area is disposed between a pair of cushioned cylinders. The rectangular patient resting area portion of the fabric material is placed beneath the shoulder and hip area of a bedfast patient such that a cushioned cylinder is located on each side of the patient in a position between the patient and a bed rail. Additionally, a soft-covered triangular cushion is removably or permanently attached to the sheet at a point equidistant from each cylindrical cushion so that the triangular cushion is located between the patient's legs. The device is used to reposition the patient either by sliding the patient along the bed longitudinally, or by rolling the patient over. Finally, after the patient is repositioned, the cushioned cylinders are used to maintain the patient in a stable position.

7 Claims, 3 Drawing Sheets

PATIENT REPOSITIONING AND POSITION MAINTENANCE DEVICE

BACKGROUND OF THE INVENTION

1. Field of the Invention

The present invention relates to a device for repositioning a bedfast patient, and more particularly to a device for maintaining the position of the bedfast patient once repositioned while at the same time providing certain preventative maintenance functions.

2.Description of the Related Art

It is well known in the nursing field that there are common and recurring problems associated with the care of bedfast patients. Generally, most such problems are due to the patient's reduced body strength and limited mobility of their upper and lower extremities. In more particular, one such problem stems from the requirement that bedridden patients must be rolled from one side to the other every two hours in order to prevent the formation of bed sores. It is also not uncommon for inclined hospital beds to cause bedfast patients to slide towards either end of the bed thereby requiring the nursing staff to move the patient along the length of the bed back into a more desirable and comfortable position. Due to the awkward weight of a bedridden patient coupled with the patient's inability to offer assistance, these repositioning tasks amount to strenuous lifting and sliding exercises and are quite difficult to perform. In fact, nurses frequently incur back injuries when attempting to reposition a bedfast patient. For fear of these injuries, nurses will occasionally neglect their repositioning duties or perform them on an irregular basis thereby subjecting the patient to undue comfort, and in so doing, possibly even enhance the formation of bed sores. A further problem associated with repositioning bedfast patients is the potential for the patient for the patient to become bruised from being bumped against the bed rails during the repositioning process.

Additionally, after the patient has been moved into a more desirable position, it is often the case that the patient will gradually migrate back into an undesirable position. Moreover, the bedfast patient will frequently migrate into a position whereby the patients's spine and hips are unstable. Accordingly, there is a need in the health care industry for a device to stabilize the bedfast patient's spine and hips while at the same time maintaining the patient's position after that patient has been repositioned.

Finally, bedfast patients are prone to a condition known in the health care industry as "hip adduction." "Adduction," in the anatomy sense, is defined as "the action by which a part of the body is drawn toward the bodily axis." *New Webster's Dictionary of the English Language,* 1981. The term "hip adduction" is generally used in the nursing industry to describe the condition occurring in a bedfast patient who has been allowed to remain in poor body alignment whereby the patient's hip muscles are drawn toward the medial line of the body thereby causing contractures to the knees. In more particular, these contractures can be described as the shortening of the hip-to-knee muscles which thereby causes the knees to be pulled toward the hips. The contractures will not necessarily occur in both legs. If the muscle contracture occurs in only one leg, then the knee of the contractured leg is forced into flesh-to-flesh contact with the inner thigh of the non-contractured leg, which contact, if maintained for even the slightest periods of time, place the patient's knee and hip joints at risk of becoming, and often do become, "frozen" such that the respective knee and inner thigh become "fixed" together. As a result, pressure areas are formed thereby causing skin irritation. As a further consequence, a break in skin integrity may develop, and ultimately result in the formation of blistery sores commonly known as decubitus ulcers. If the muscle contracture occurs in both legs, then both knees are forced against one another thereby causing the same difficulties, only in a different location.

This condition can be broken into three problematic aspects: (1) the muscle contractures resulting from the patient's poor body alignment; (3) the skin irritation and sores resulting from the contractures; and (3) the risk that the contractures, if not prevented, will cause the joints to become fixed in a "frozen" state.

Heretofore, nurses have attempted to deter this condition first by using pillows to maintain the patient's body alignment, thereby eliminating the muscle contractures. In those situations where the contractures occurred before the nurse detected the improper body alignment, nurses have attempted to address the skin irritation and "frozen" joint aspects by simply placing pillows between the patient's legs. Unfortunately, some nurses will not take the time to locate a pillow for this purpose, and even when they do, experience has shown that even minimal shifting or "wiggling" movements by the patient tend to cause the pillow to gravitate out of position and become dislodged. Furthermore, pillows used in hospitals and nursing homes are covered with plastic, and although the plastic-covered pillows are also covered with a cloth pillow case, the pillow case will occasionally become displaced thereby exposing the patient's bare leg to the plastic and become irritated. Therefore, there is an urgent need in the nursing industry for a reliable device to prevent this disturbing and troublesome condition.

A preliminary search was conducted in the United States Patent and Trademark Office which produced the following references:

| | | |
|---|---|---|
| 2,644,173 | 4,723,327 | 4,872,228 |
| 3,284,816 | 4,754,509 | 5,148,558 |
| 3,829,914 | 4,872,226 | |

James U.S. Pat. No. 2,644,173 shows an impervious sheet with inflatable sides; Laubsch U.S. Pat. No. 3,284,816 shows a supplemental bed sheet combination employing rigid rods; Treat U.S. Pat. No. 3,829,914 shows a stretcher type patient positioning device; Smith U.S. Pat. No. 4,723,327 shows another patient mover; Pollard U.S. Pat. No. 4,754,509 shows a retainer sheet; Lonardo U.S. Pat. No. 4,872,226 shows a means for positioning bedfast patients employing straps, buckles, and hooks; Bishop U.S. Pat. No. 4,872,228 shows a bed guard to reduce the risk of falling out of bed; and Dunn U.S. Pat. No. 5,148,558 shows a patient transfer sheet.

SUMMARY OF THE INVENTION

The present invention is directed to a patient positioning and position maintenance device that solves and satisfies the above-explained problems and needs. The device comprises a rectangular sheet of fabric material, and a pair of cylindrical cushions. The rectangular sheet of fabric material is folded and stitched such that a rectangular patient resting area is disposed between a pair of cylindrical pockets. The cylindrical pockets are situated on opposite sides of the rectangular patient resting area. Each cylindrical pocket houses a cylindrical cushion. One of the cylindrical pockets with cushion therein can be used to maintain the position of a bedfast patient by rolling the cylindrical pocket with cushion therein snugly against the bedfast patient's shoulder, back and buttocks. The device may also be used to slide a bedfast patient along the length of the bed.

The device can be further defined in terms of how the cylindrical cushions in relation to the cylindrical pockets may be removed and inserted. Initially, the rectangular sheet of material is folded and stitched such that each cylindrical pocket is formed with open ends. In one embodiment, the open ends of the cylindrical pockets are both permanently enclosed by stitching a circular fabric end cover thereto. Each cylindrical pocket is provided with a linear portal along its length through which a cylindrical cushion is inserted and removed. Each linear portal is provided with means for maintaining the portal in a closed position.

As a second embodiment, each cylindrical pocket is closed at one end only by stitching a circular fabric pocket bottom cover thereto. A circular fabric pocket entrance cover is removably attached to the other open end of each cylindrical pocket.

Furthermore, the device may be provided with a removable or permanently attached leg cushion, the purpose of which is to address the hip adduction concerns described above. The leg cushion may be triangular or semi-circular in shape, and is removably or permanently attached to the rectangular sheet of material so that it is centered between the cylindrical pockets. The leg cushion may be permanently stitched to the rectangular sheet of fabric material. Alternatively, the leg cushion may be removably attached to the rectangular sheet of fabric material by using a hook and loop type fastener such as Velcro® and Velfoam®. In addition, the leg cushion may be covered by two layers of material: a water-resistant inner cover, and a soft outer cover. The inner cover is permanently stitched about the leg cushion such that the entirety of the leg cushion is completely and closely surrounded. The outer cover is removably attached around the entirety of the inner cover by using Velcro®.

Finally, there are three variations of the cylindrical cushions. First, the cylindrical cushions may be hollow and made from a sheet of convoluted foam material which is rolled into a cylindrical shape such that the cylindrical cushions have a convoluted outer surface. Secondly, the cylindrical cushions may be hollow and have a smooth, non-convoluted outer surface. Thirdly, the cylindrical cushions may be made from a solid foam material and have a smooth, non-convoluted outer surface.

These and other features and aspects of the present invention will become evident from the following description, appended claims, and accompanying drawings.

DESCRIPTION OF THE PREFERRED EMBODIMENTS

Figure 1:
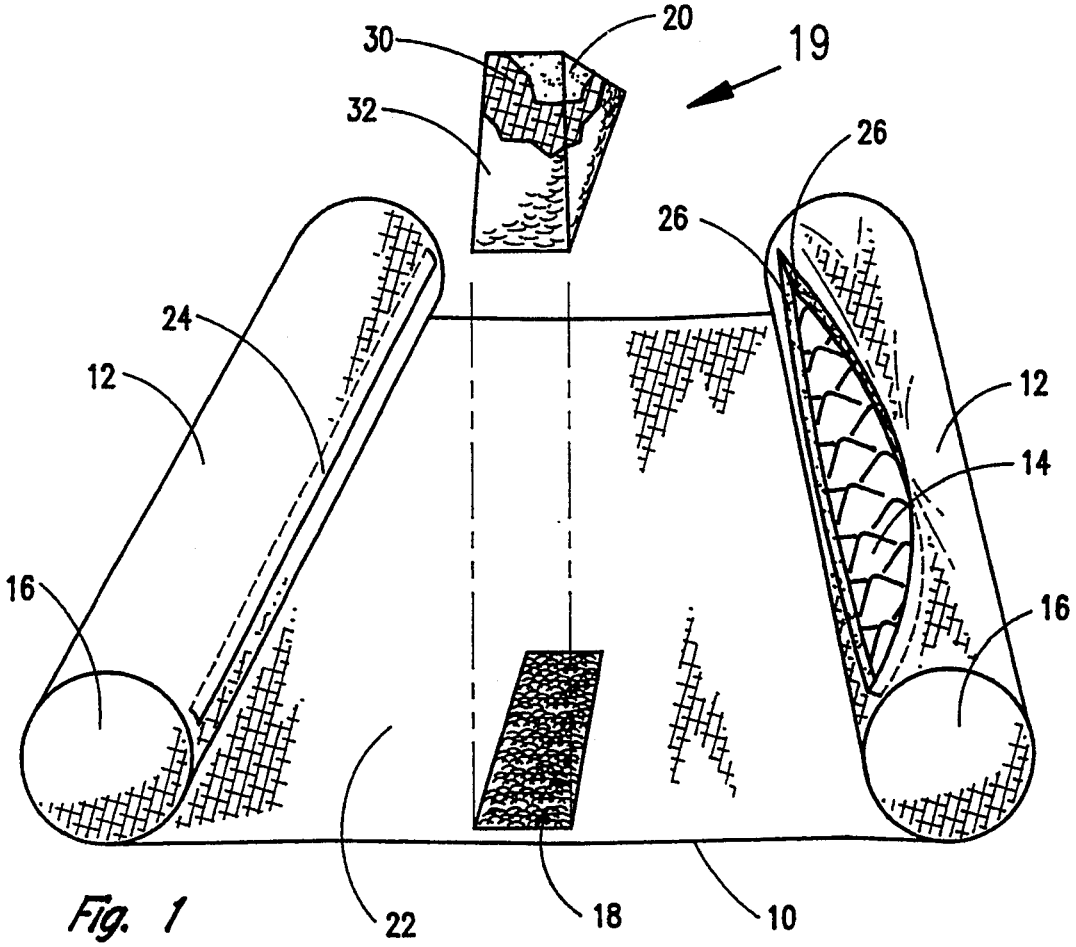
FIG. 1 is a perspective view of a first embodiment of the positioning device shown with one of the cylindrical cushions partially exposed through the side cushion portal, and demonstrating the detachable nature of an optional triangular cushioned knee wedge.

As shown in FIG. 1, the first preferred embodiment of a positioning device broadly comprises a rectangular fabric sheet of material 10 having two cylindrical pockets 12 opposite one another, two cylindrical cushions 14 (one shown partially exposed, and one not visible), four pocket end covers 16 (two visible, and two hidden from view), a Velcro® strip 18, and an optional triangular knee wedge 19 shown in the detached position. The rectangular fabric sheet of material 10 is sewn in a manner whereby the cylindrical pockets 12 are formed by a single layer of fabric material whereas the rectangular patient resting area 22 is constructed of a double layer of fabric material. The width of the patient resting area 22 being the distance between the cylindrical pockets 12 should be approximately equal to the width of the bed upon which the device is to be used. The length of the patient resting area 22 should be approximately 3 feet in length. The pocket end covers 16 consist of circular sheets of fabric material which are permanently sewn to the ends of the cylindrical pockets 12 wherein the cylindrical cushions 14 are housed.

Figure 2:
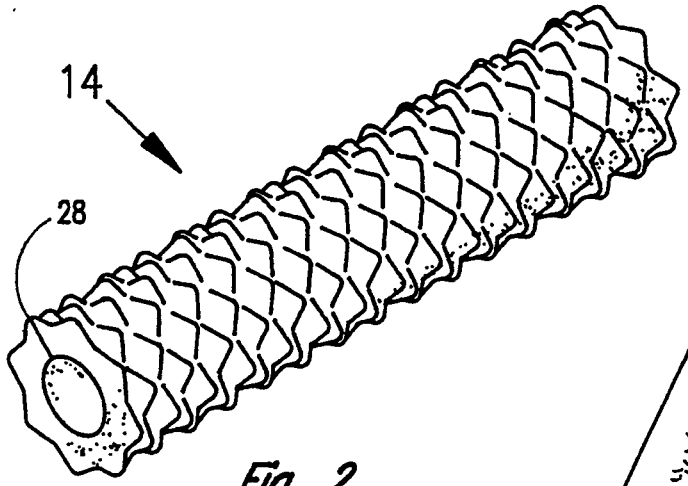
FIG. 2 is a perspective view of a cylindrical cushion showing its construction from convoluted foam and hollowed characteristic.

The cylindrical cushions 14, as more fully shown in FIG. 2, are preferably 8 inches in diameter, approximately 3 feet in length, and manufactured from convoluted (sound-proofing type), medical grade, non-hypoallerginic, virgin polyurethane, combustion modified/CAL.-177 material. The cylindrical cushions 14 are fabricated by taking a flat piece of the above-specified convoluted foam, rolling same into a hollow cylinder, and gluing the edges together with an adhesive thereby forming a seam 28, as shown in FIG. 2. The resulting cylindrical cushion 14 has an outer surface consisting of intermittent ridges and recesses. Referring back to FIG. 1, the cylindrical pockets 12 have a linear opening 24 along their length through which the cylindrical cushions 14 are inserted and removed. The linear openings 24 are opened and closed by separating or fastening the respective mating Velcro® strips 26.

Figure 3:
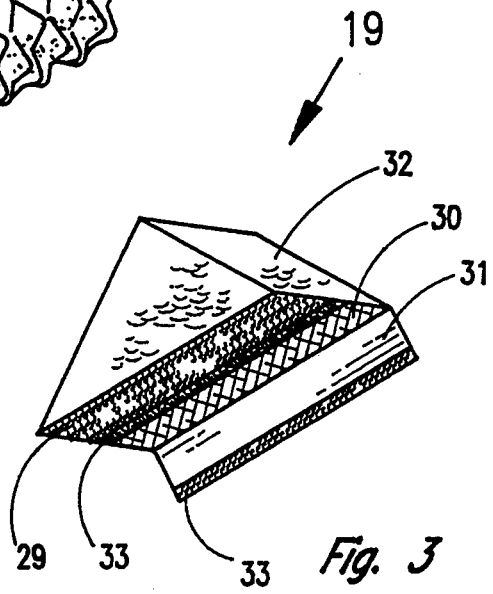
FIG. 3 is a perspective view of the knee wedge showing the manner in which the lower flaps of the outer cover are used to fasten the outer cover about the triangular cushion.
Figure 6:
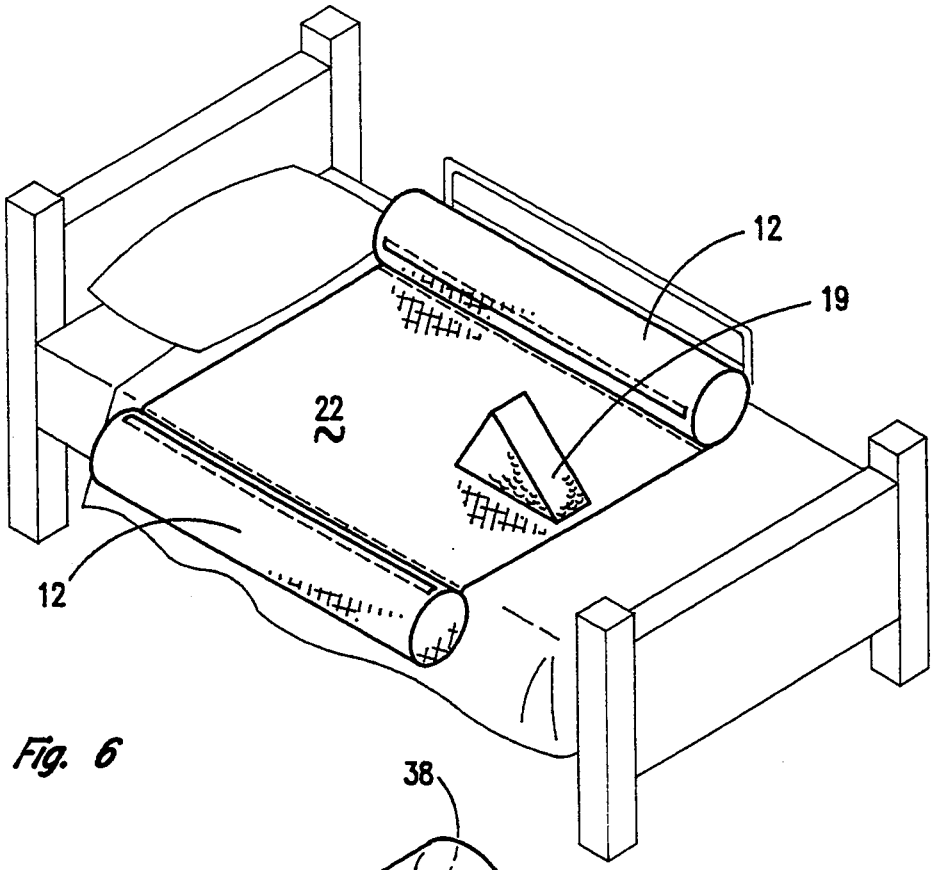
FIG. 6 is a perspective view of the positioning device of FIG. 1 shown with the triangular cushion in the attached position, and a cushioned cylinder hanging over the side of the bed in the loading position.

The optional knee wedge 19 consists of three parts: (1) a triangular cushion 20, which is preferably 2 inches wide, 22 inches along its base, 14 inches tall, and manufactured from medical grade, non-hypoallergic, virgin polyurethane, combustion modified/CAL.-177; (2) a permanently attached inside cover 30, which is preferably made from a water repellant, urethane coated, 1.9 ounce/square yard, rip stop nylon fabric; and (3) a removable outside cover 32, which is preferably made from a non-flammable, non-toxic, 35 ounce/linear yard, 100% polyester fabric, preferably Fortell or Kodell. The inside cover 30 should be permanently sewn such that it completely covers and surrounds the entirety of the triangular cushion 20. The purpose of the inside cover 30 is to prevent the triangular cushion 20 from coming into contact with any accidental urination, excrement, or other patient discharge. The outside cover 32, as better shown in FIG. 3, is a removable, soft sleeve which slips over the inside cover 30 thereby rendering the cushion comfortable to a patient's bare legs (not shown). The outside cover 32 is secured about the inside cover 30 by fastening the inner flap 29 (shown in the folded position) to the outer flap 31 (shown in the hanging or unfolded position). This flap fastening is accomplished by securing the Velcro® strips 33 to one another. In addition, Velcro® strips should be attached to the outer surfaces of flaps 29 and 31 for mating with strip 18 (recall FIG. 1). The knee wedge 19 may be treated as a removable option as shown in FIG. 1, or it may be permanently attached to the positioning device as shown in FIG. 6. Additionally, the knee wedge 19 need not necessarily be triangular in shape, but may be configured in a semi-circular or other suitable geometric shape (not shown).

Figure 4:
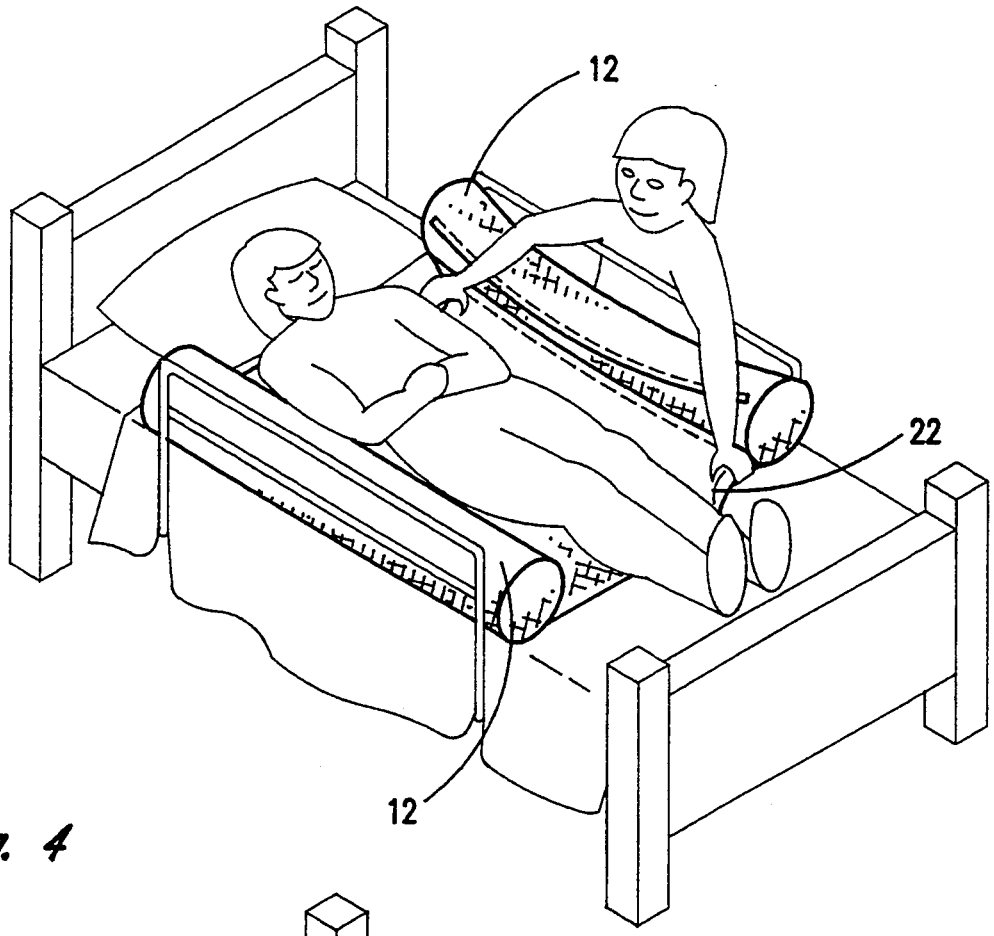
FIG. 4 is a perspective view of the positioning device of FIG. 1 (absent the triangular cushion) shown resting on a hospital bed and beneath a bedridden patient, and being used by a nurse to reposition the patient.

FIG. 4 demonstrates the positioning device being used by a nurse to either roll the patient over, or to move the patient longitudinally along the bed. The nurse may roll the patient over by grasping a cylindrical pocket 12 with cylindrical cushion 14 therein, rolling same toward the patient, and then pulling upwards (i.e. toward the ceiling) thereby causing the patient to roll away from the nurse. The nurse may slide the patient up or down the length of the bed by grasping the patient resting area 22 as shown, and pulling in the desired direction.

Figure 5:
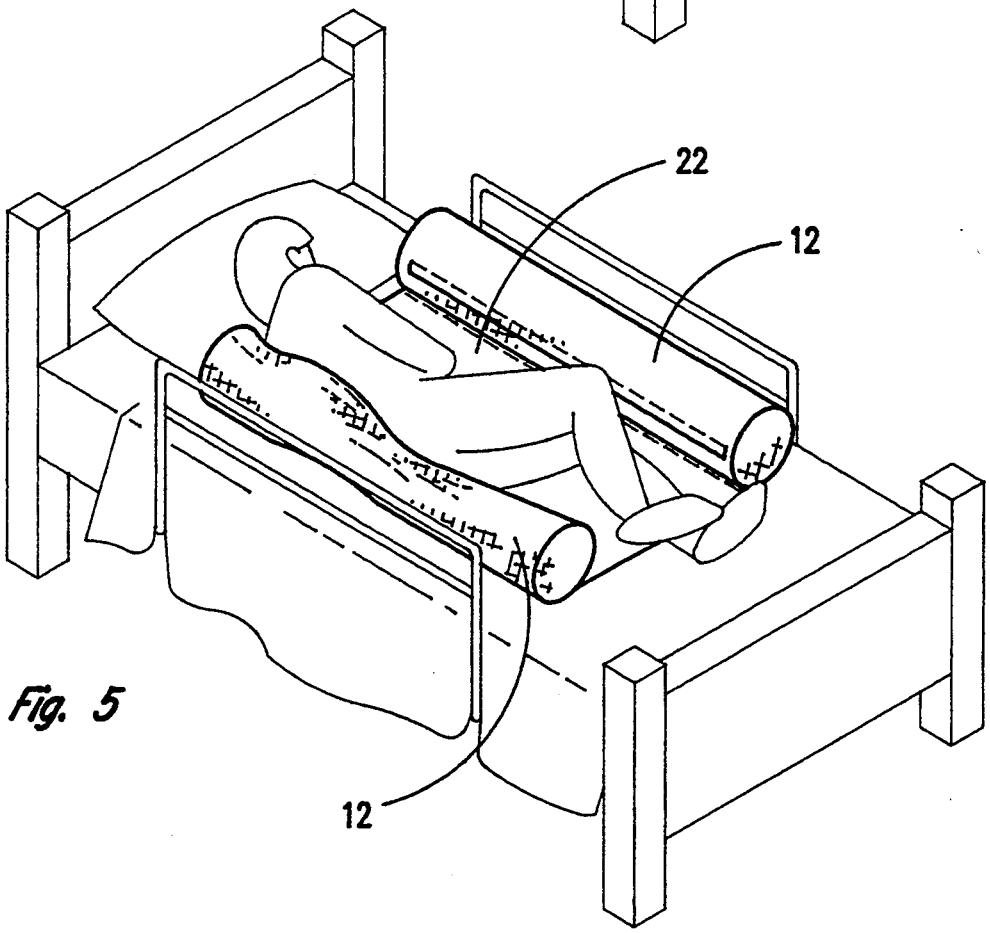
FIG. 5 is a perspective view of the positioning device of FIG. 1 (absent the triangular cushion) shown resting on a hospital bed and beneath a bedridden patient, and demonstrating the use of one of the cushioned cylinders to maintain the position of the patient.

FIG. 5 shows one of the cylindrical pockets 12 with cylindrical cushion 14 therein being used to maintain the position of the patient such that the patient's spine and hips are stabilized. The nurse places the cylindrical pocket 12 with cylindrical cushion 14 therein by rolling it snugly against the patient's shoulder, back, and buttocks.

FIG. 6 shows the manner in which the positioning device should be configured when preparing to load a patient onto the bed. In more particular, the positioning device should be placed on the bed with one of the cylindrical pockets 12 with cylindrical cushion 14 therein hanging over the side of the bed. Once on the bed, the patient's legs should straddle knee wedge 19.

Figure 7:
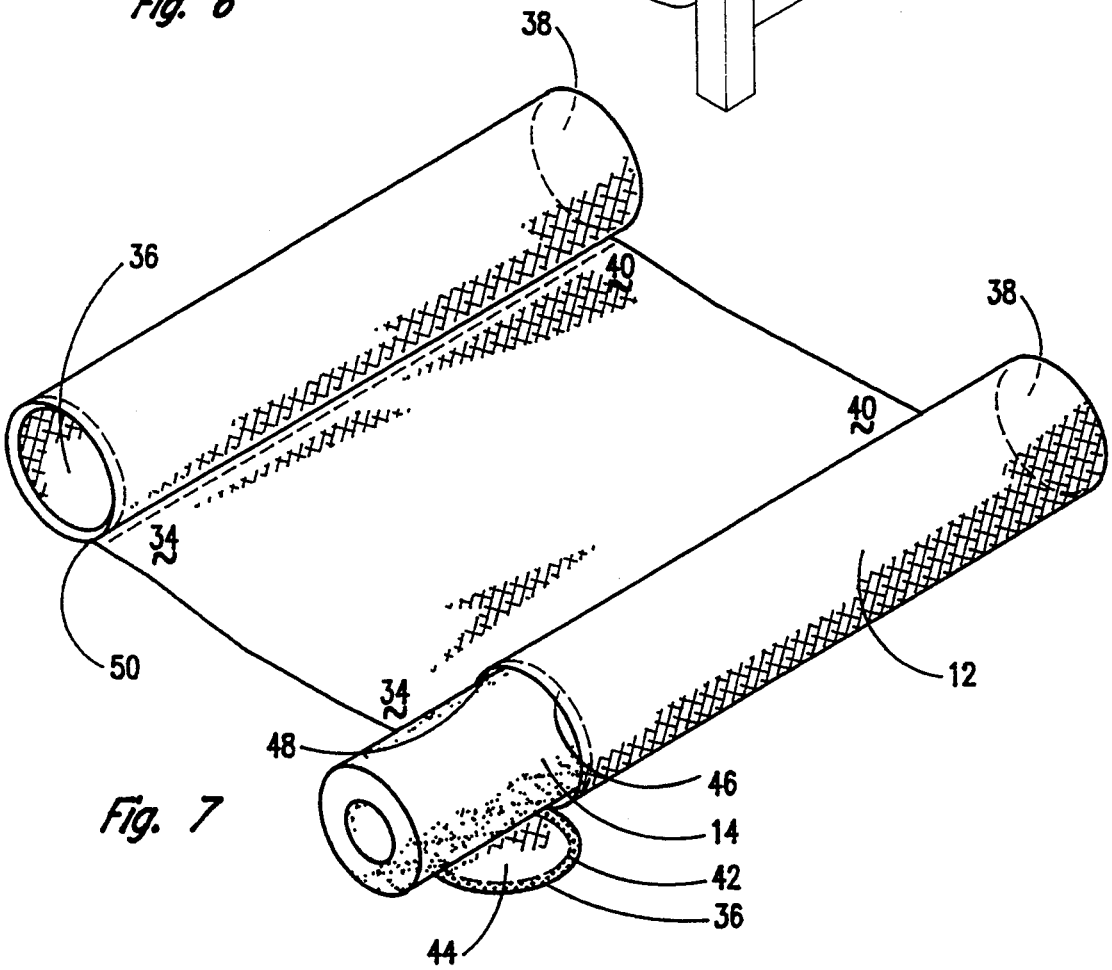
FIG. 7 is a perspective view of a second embodiment of the positioning device shown with an alternative end cushion portal, and also an alternative non-convoluted (i.e. smooth) hollowed-out cushioned cylinder.

As shown in FIG. 7, a second preferred embodiment of the positioning device provides an alternative placement of the entrance portal through which the cylindrical cushions 14 are inserted into the cylindrical pockets 12. This embodiment also demonstrates the option of using a non-convoluted (i.e. smooth) cushioned cylinder. When using a non-convoluted cushioned cylinder, the cylinder may be either solid throughout (not shown), or it may be hollowed-out as shown.

Instead of the side entry model as shown in FIG. 1, this second embodiment depicted in FIG. 7 is constructed so that the cylindrical cushions 14 (one shown partially removed, and one not visible) are inserted through the entrance ends 34 of the cylindrical pockets 12. This embodiment contains two pocket entrance covers 36, and two pocket bottom covers 38, whereas the first embodiment contained four pocket end covers 16. The pocket bottom covers 38 consist of circular sheets of fabric material which are permanently sewn to the closed ends 40 of the cylindrical pockets 12. The pocket entrance covers 36 consist of circular sheets of fabric material having strips of Velcro® 42 attached to the entire periphery of their inner surfaces 44. A mating Velcro® strip 46 is also attached about the periphery of the interior surfaces 4 of the entrance ends 34 of the cylindrical pockets 12. The pocket entrance covers 36 are maintained in their closed position by placing Velcro® strip 42 in continuous contact with Velcro® strip 46. A substantially small portion of each pocket entrance cover 36 is permanently sewn to the entrance ends 34 of the cylindrical pockets 12 at intersections 50. This permanent attachment of the pocket entrance covers 36 operates to prevent their loss or misplacement during removal of the cylindrical cushions 14. For best results, it should be noted that a non-convoluted (i.e. smooth) cylindrical cushion should be used with this end entry portal embodiment because the ridges on the convoluted cylindrical cushions tend to catch on the inner walls of the cylindrical pockets 12, thereby rendering the cushion insertion process difficult and cumbersome.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. An adult patient repositioning and position maintenance device adapted to be positioned on the supporting surface of a bed of conventional width, comprising:

a rectangular sheet of fabric material, a pair of resilient cylindrical cushions, the rectangular sheet of fabric material being folded and stitched such that a rectangular patient resting area is disposed between a pair of cylindrical pockets, the cylindrical pockets being situated on opposite sides of the rectangular patient resting area, each cylindrical pocket having a cylindrical cushion received therein, the distance between the cylindrical pockets being approximately equal to the width of the bed upon which the device is used, a leg cushion, and means for connecting the leg cushion to the rectangular sheet of fabric material, the leg cushion being attached to the rectangular sheet of fabric material equidistant from each cylindrical pocket, whereby one of the cylindrical pockets with cushion therein can be used to maintain the position of a bedfast patient by rolling the cylindrical pocket with cushion therein snugly against the bedfast patient's shoulder, back and buttocks.

2. A patient repositioning and position maintenance device as recited in claim 1 further comprising:

four circular fabric cylindrical pocket end covers, each cylindrical pocket initially being formed with open ends, each open end of the cylindrical pockets being enclosed by stitching a circular fabric cylindrical pocket end cover thereto, each cylindrical pocket having a linear portal along its length through which a cylindrical cushion is inserted and removed, the linear portal having means for maintaining the portal in a closed position.

3. A patient repositioning and position maintenance device as recited in claim 1 further comprising:

two circular fabric pocket entrance covers, and two circular fabric pocket bottom covers, each cylindrical pocket having a closed end and an entrance end through which a cylindrical cushion is inserted and removed, the closed ends of the cylindrical pockets being permanently enclosed by stitching a circular fabric pocket bottom cover thereto, a circular fabric pocket entrance cover being removably attached to each entrance end of each cylindrical pocket by an attaching means.

4. A patient repositioning and position maintenance device as recited in claim 1 further comprising:

an inner cover being permanently affixed about the leg cushion by a stitching means such that the entirety of the leg cushion is completely and closely surrounded, an outer cover being removably and closely attached by an attaching means about the entirety of the inner cover, and wherein the means for connecting the leg cushion to the rectangular sheet of fabric material comprises a means for connecting the outer cover to the rectangular sheet of fabric material, a mating portion of the connecting means being located at a point on the rectangular sheet of fabric material equidistant from each cylindrical pocket.

5. A patient repositioning and position maintenance device as recited in claim 1 wherein the cylindrical cushions are hollow and are made from a sheet of convoluted foam material which is rolled into a cylindrical shape such that the cylindrical cushions have a convoluted outer surface.

6. A patient repositioning and position maintenance device as recited in claim 1 wherein the cylindrical cushions are hollow and have a smooth, non-convoluted outer surface.

7. A patient repositioning and position maintenance device as recited in claim 1 wherein the cylindrical cushions are solid throughout their entirety and have a smooth, non-convoluted outer surface.

* * * * *